US010593469B2

(12) United States Patent
Idogawa et al.

(10) Patent No.: US 10,593,469 B2
(45) Date of Patent: Mar. 17, 2020

(54) IGNITION APPARATUS

(71) Applicant: Mitsubishi Electric Corporation, Tokyo (JP)

(72) Inventors: Takashi Idogawa, Tokyo (JP); Naoki Kataoka, Tokyo (JP); Yuichi Muramoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/029,203

(22) Filed: Jul. 6, 2018

(65) Prior Publication Data

US 2019/0311849 A1 Oct. 10, 2019

(30) Foreign Application Priority Data

Apr. 6, 2018 (JP) ..... 2018-073594

(51) Int. Cl.

| | |
|---|---|
| ***F02P 3/04*** | (2006.01) |
| ***H01F 38/12*** | (2006.01) |
| ***F02P 3/02*** | (2006.01) |
| *F02D 37/02* | (2006.01) |

(52) U.S. Cl.

CPC ..... *H01F 38/12* (2013.01); *F02P 3/02* (2013.01); *F02D 37/02* (2013.01)

(58) Field of Classification Search

CPC ..... H01F 38/12; F02P 3/02; F02P 3/04; F02P 3/0407; F02D 37/02

USPC ..... 123/605, 618, 621

See application file for complete search history.

(56) References Cited

U.S. PATENT DOCUMENTS

| | | | | |
|---|---|---|---|---|
| 4,641,626 | A | 2/1987 | Morino et al. | |
| 4,702,221 | A * | 10/1987 | Tokura | F02P 3/0442 123/606 |
| 4,770,152 | A * | 9/1988 | Mogi | F02P 7/035 123/621 |
| 5,886,476 | A * | 3/1999 | Skinner | F02P 9/007 123/621 |
| 7,681,562 | B2 * | 3/2010 | Boerjes | F02P 3/053 123/595 |

(Continued)

FOREIGN PATENT DOCUMENTS

| | | | |
|---|---|---|---|
| JP | 61-261665 | A | 11/1986 |
| JP | 61-294167 | A | 12/1986 |

(Continued)

OTHER PUBLICATIONS

Communication dated Feb. 19, 2019, from Japanese Patent Office in counterpart application No. 2018-073594.

(Continued)

*Primary Examiner* — Hai H Huynh

(74) *Attorney, Agent, or Firm* — Sughrue Mion, PLLC; Richard C. Turner

(57) ABSTRACT

A current flowing in a sub-primary coil can be limited in an ignition apparatus in which a voltage, generated in a secondary coil at a timing when a current in a main primary coil is cut off, generates a secondary current, and then the sub-primary coil is energized so that a superimposition current is generated in the secondary coil and in which a sub-IC connected in series with the sub-primary coil is pulse-controlled so that a current flowing in the sub-primary coil is controlled and hence the superimposition current is controlled.

14 Claims, 2 Drawing Sheets

(56) References Cited

U.S. PATENT DOCUMENTS

| | | | | |
|---|---|---|---|---|
| 9,399,979 | B2 | 7/2016 | Heise et al. | |
| 2005/0000502 | A1 * | 1/2005 | Waters | F02P 3/0453 123/620 |
| 2018/0277302 | A1 | 9/2018 | Sekine et al. | |

FOREIGN PATENT DOCUMENTS

| | | | |
|---|---|---|---|
| JP | 2018162757 | A | 10/2018 |
| WO | 2016/157541 | A1 | 10/2016 |

OTHER PUBLICATIONS

Communication dated Nov. 8, 2019 from the Japanese Patent Office in application No. 2019-075292.

* cited by examiner

IGNITION APPARATUS

BACKGROUND OF THE INVENTION

Field of the Invention

The present application relates to an ignition apparatus to be mounted, for example, in an internal combustion engine.

Description of the Related Art

In order to improve the gasoline mileage of an internal combustion engine, there has been studied an internal combustion engine in which a leaning method or a high-EGR (Exhaust Gas Recirculation) method is adopted; however, because the ignitability of a fuel-air mixture of each of these internal combustion engines is not high, a high-energy, especially, a large-current ignition apparatus is required. Accordingly, as disclosed, for example, in Patent Document 1, there has been proposed an ignition apparatus in which on a secondary output outputted by cutting off the current in a conventional primary coil (main primary coil), output energy (current) produced by another primary coil (sub-primary coil) is superimposed in an additive manner.

It is known that in addition to a power-source voltage to be applied to the sub-primary coil, a voltage (a plug resistance and a current flowing therein, and the voltage across a plug gap) to be applied to an ignition plug, and a voltage drop produced by the resistance of a secondary coil provide effects to the secondary superimposition current produced by the sub-primary coil. Therefore, although when the secondary current is carelessly increased, the flammability is satisfied, the increase in the secondary current enlarges heat generation in the secondary coil; thus, there is caused a problem that the ignition apparatus is broken or that the gap terminals of the ignition plug to which energy (a current) is supplied are worn away.

In order to limit (control) this current, as disclosed, for example, in Patent Document 2, there has been proposed an apparatus in which a switching device (sub-IC) connected in series with the sub-primary coil is pulse-controlled (on/off-control or PWM-control of the sub-IC) so that the average value of the current flowing in the sub-primary coil is controlled and hence the secondary superimposition current is controlled.

[Patent Document 1] SPECIFICATION of U.S. Pat. No. 9,399,979

[Patent Document 2] International Publication No. 2016/157541

However, because when the current flowing in the sub-primary coil is accurately controlled through the foregoing method, it is required to switch the sub-IC in a high-speed fashion, a device capable of being switched in a high-speed fashion needs to be selected and a loss due to the switching is caused. Moreover, when the sub-IC is switched after the secondary current has been cut off through the main primary coil, a voltage having a polarity opposite to that in the case of a normal ignition is generated and the voltage may cause damage to the device incorporated in the ignition apparatus; thus, it is required to take measures for avoiding this damage.

SUMMARY OF THE INVENTION

The present application has been implemented in order to solve the foregoing problems; the objective thereof is to obtain an ignition apparatus that limits a secondary superimposition current, with a simple configuration.

An ignition apparatus according to the present application is provided with a main primary coil that generates positive-direction energization magnetic flux when energized by a power source and generates opposite-direction de-energization magnetic flux when de-energized, a main switching device that is connected with the main primary coil and performs switching between energization and de-energization of the main primary coil, a sub-primary coil that generates magnetic flux having a direction the same as that of the de-energization magnetic flux when energized by the power source, a sub-switching device that is connected with the sub-primary coil and performs switching between energization and de-energization of the sub-primary coil, and a secondary coil whose one terminal is connected with an ignition plug and that is magnetically coupled with the main primary coil and the sub-primary coil so as to generate discharge energy; the ignition apparatus is characterized in that a voltage generated in the secondary coil at a timing when the main switching device is de-energized generates a secondary current, and then the sub-switching device is energized and hence the sub-primary coil is energized so that a superimposition current is generated in the secondary coil and a current flowing in the sub-primary coil is limited.

The ignition apparatus disclosed in the present application makes it possible that the current flowing in the sub-primary coil is limited so that when the power-source voltage or the voltage to be applied to the ignition plug changes, the superimposition current is prevented from becoming excessively large.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Figure 1:
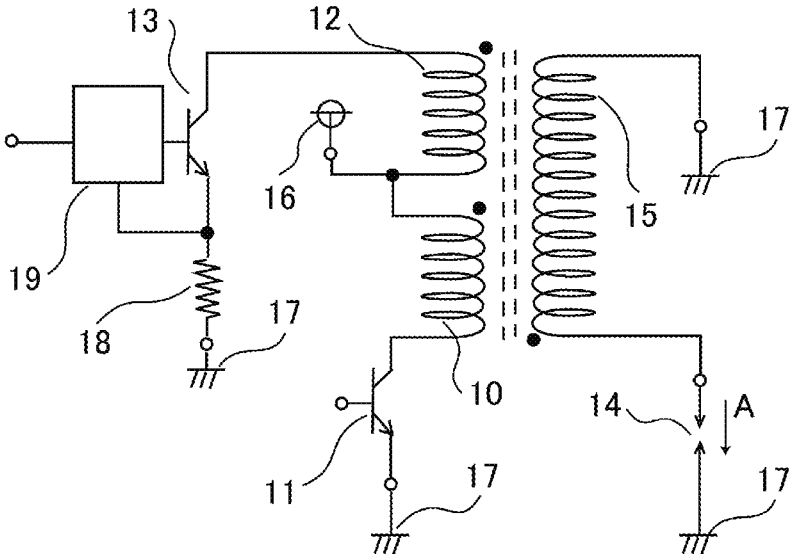
FIG. 1 is a circuit diagram representing an ignition apparatus according to Embodiment 1.

Hereinafter, an ignition apparatus according to the present application will be explained in detail with reference to the drawings. In each of the drawings, the same reference characters denote the same or similar portions.

Embodiment 1

Figure 2:
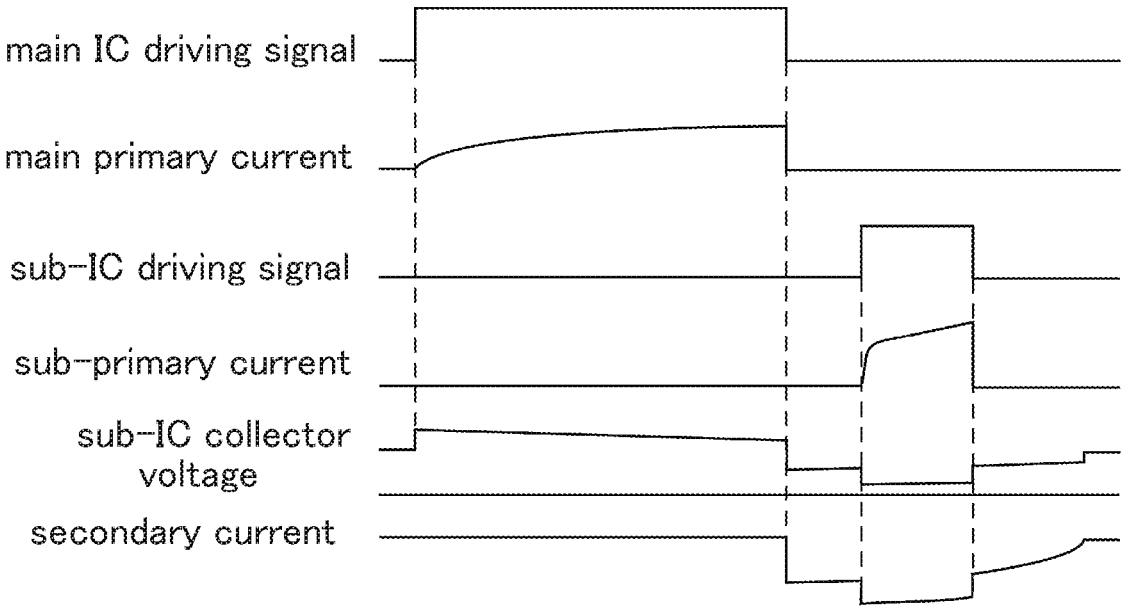
FIG. 2 is a chart representing operation waveforms at a time when the ignition apparatus according to Embodiment 1 is in a normal state.
Figure 3:
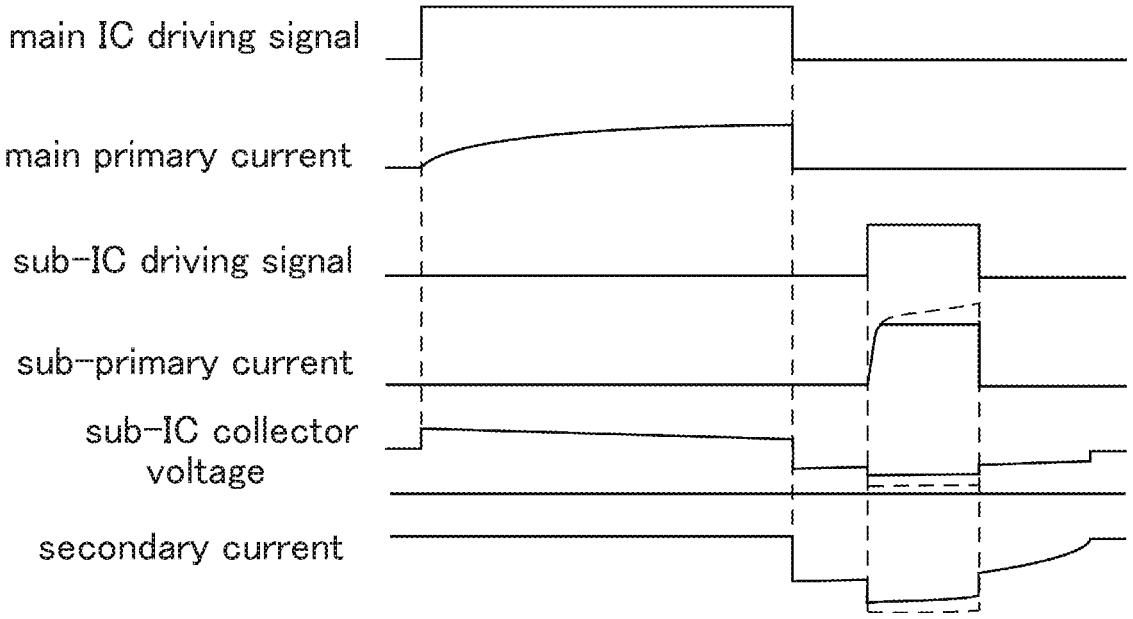
FIG. 3 is a chart representing operation waveforms at a time when the ignition apparatus according to Embodiment 1 is in a current-limiting state.

FIG. 1 is a circuit diagram representing an ignition apparatus according to Embodiment 1. FIG. 2 is a chart representing operation waveforms at a time when the ignition apparatus represented in FIG. 1 is in a normal state (the power-source voltage: 13.5 V, at a normal temperature, the voltage across the ignition plug: 1 kV). FIG. 3 is a chart representing operation waveforms at a time when the power-source voltage of the ignition apparatus represented in FIG. 1 is increased (power-source voltage: 16 V).

As represented in FIG. 1, the ignition apparatus according to Embodiment 1 is provided with a main primary coil 10, a main switching device (hereinafter, referred to as a main IC) 11 that is connected with one terminal of the main primary coil 10 and performs switching between energization and de-energization of the main primary coil 10, a sub-primary coil 12, a sub-switching device (hereinafter, referred to as a sub-IC) 13 that is connected with one terminal of the sub-primary coil 12 and performs switching between energization and de-energization of the sub-primary coil 12, and a secondary coil 15 whose one terminal is connected with an ignition plug 14 and that is magnetically coupled with the main primary coil 10 and the sub-primary coil 12 so as to generate discharge energy.

The respective other terminals of the main primary coil 10 and the sub-primary coil 12 are connected with one and the same power source 16. The main primary coil 10 is wound in such a way that when the power source 16 supplies a current thereto, the polarity thereof becomes opposite to that of the secondary coil 15; the sub-primary coil 12 is wound in such a way that when the power source 16 supplies a current thereto, the polarity thereof becomes the same as that of the secondary coil 15. In other words, the main primary coil 10 and the sub-primary coil 12 are wound in such a way that the respective polarities thereof are opposite to each other when viewed from the power source 16. Accordingly, when energized, the main primary coil generates positive-direction energization magnetic flux; when de-energized, the main primary coil generates opposite-direction de-energization magnetic flux. When energized, the sub-primary coil generates magnetic flux having a direction the same as that of the de-energization magnetic flux.

The collector of the main IC 11 is connected with the main primary coil 10; the emitter thereof is connected with a GND 17. The collector of the sub-IC 13 is connected with the sub-primary coil 12; the emitter thereof is connected with the GND 17 through a current detection resistor 18. The voltage across a current detection resistor 18 is inputted to a gate control circuit 19 that controls the gate voltage of the sub-IC 13; the gate of the sub-IC 13 is controlled in such a way that the voltage across the current detection resistor 18 becomes constant, i.e., the current flowing in the sub-primary coil 12 becomes constant.

Next, the operation of the ignition apparatus according to Embodiment 1 will be explained with reference to FIGS. 2 and 3. From the top position in each of FIGS. 2 and 3, respective waveforms represent a driving signal for the main IC 11, a current (hereinafter, referred to as a main primary current) flowing in the main primary coil 10, a driving signal for the sub-IC 13, a current (hereinafter, referred to as a sub-primary current) flowing in the sub-primary coil 12, a collector voltage of the sub-IC 13, and a secondary current obtained by adding a secondary current caused by the main primary coil 10 and a superimposition current caused by the sub-primary coil 12, in that order.

FIG. 2 represents operation waveforms at a time of the normal state; in accordance with on/off-switching of the driving signal for the main IC 11, the main primary coil 10 is energized or de-energized. When the main primary current is cut off, a mutual induction effect causes a large negative voltage (not represented in FIG. 2) across the secondary coil 15. This voltage causes a discharge in the gap of the ignition plug 14; then, a negative current flows in the secondary coil 15. In FIG. 1, the positive direction of the secondary current is indicated by the arrow A.

Next, when the sub-IC 13 is turned on, a current immediately starts to flow in the sub-primary coil 12 (in a state where the rise of the current is quick); then the current gradually increases. As a result, a current corresponding to the turn ratio between the sub-primary coil 12 and the secondary coil 15 is superimposed on the secondary current. After that, when the sub-IC 13 is turned off, the sub-primary current is cut off, and hence the current to be superimposed on the secondary current becomes zero.

Hereinafter, the explanation for the present Embodiment will be made while showing specific values. In the present embodiment, designing is implemented in such a way that the voltage drop caused by the resistance of the secondary coil 15 becomes substantially 1 kV when the energization of the sub-IC 13 is started. Therefore, the induction voltage across the secondary coil 15 becomes 2 kV, which is the addition of the foregoing voltage drop of 1 kV and the voltage across the ignition plug of 1 kV. Because the turn ratio between the sub-primary coil 12 and the secondary coil 15 is set to 200, the induction voltage caused across the sub-primary coil 12 becomes substantially 10 V. Moreover, when the voltage between the collector and the emitter of the sub-IC 13 is set to substantially 2 V and the resistance of the sub-primary coil 12 is set to substantially 0.2Ω, the sub-primary current becomes substantially 10 A when the sub-IC 13 is turned on, and then increases gradually. In accordance with the sub-primary current, the secondary current includes a superimposition current of substantially 50 mA.

In contrast, FIG. 3 represents operation waveforms at a time when the power-source voltage increases; in the case where the sub-primary current is not limited, the sub-primary current becomes substantially 18 A, as represented by a broken line in FIG. 13, after the sub-IC 13 is turned on; as a result, as represented by a broken line in FIG. 3, a superimposition current of substantially 90 mA is included in the secondary current; thus, when the power-source voltage increases, the superimposition current largely increases.

Accordingly, when as represented in FIG. 1, the current detection resistor 18 of, for example, substantially 10 mΩ is provided at the emitter side of the sub-IC 13, it is made possible to make the voltage across the current detection resistor 18 become, for example, 0.12 V. In other words, the gate control circuit 19 controls the gate voltage of the sub-IC 13 in such a way that the current that flows in the current detection resistor 18 becomes 12 A. As a result, the voltage between the collector and the emitter of the sub-IC 13 increases, so that the superimposition current included in the secondary current is limited to 60 mA. The resistance value of the current detection resistor 18 is set to a small value, and hence the effect thereof provided to the sub-primary current is suppressed to be small. Moreover, when the current that flows in the current detection resistor 18 is set within a range from 10 A to 20 A, it is made possible that while the superimposition current is secured, the current that flows in the sub-primary coil 12 and the sub-IC 13 prevents heat generation in the sub-primary coil 12 and the sub-IC 13. Thus, it is preferable that the current detection resistor 18 is formed of a variable resistor.

As described above, in the ignition apparatus according to Embodiment 1, the voltage between the collector and the emitter of the sub-IC 13 is increased so that the increasing amount of the superimposition current at a time when the power-source voltage is changed can be suppressed; thus, the maximum value of the secondary current can be limited. As a result, the secondary coil 15 can be prevented from being excessively heated, and the ignition plug 14 can be prevented from being excessively worn away.

Moreover, because under the normal usage condition represented in FIG. 2, the current is not suppressed, the amount of the superimposition current can sufficiently be secured also in the normal state. Still moreover, because the upper limit of the current to be utilized is set to 12 A, it is made possible to utilize another switching device having a current capacity the same as that of the main IC 11. Furthermore, not only the superimposition current in the secondary current, but also the current that flows in the sub-primary coil 12 can be reduced, heat generation in the secondary coil 15 and the sub-primary coil 12 can also be suppressed.

In the normal state where the voltage of the power source 16 or the voltage to be applied to the ignition plug 14 does not change, the current that flows in the sub-primary coil 12 is set to be unlimited, so that the sub-primary current is not limited; thus, the output performance in the normal state is not limited.

The foregoing numerical value is an example, and the current may be limited to another value. Although the respective polarities of the main primary coil 10 and the secondary coil 15 are opposite to each other; however, the respective polarities thereof may be the same. Moreover, the main primary coil 10 and the sub-primary coil 12 are connected with one and the same power source; however, the main primary coil 10 and the sub-primary coil 12 may be connected with respective different power sources (e.g., 12 V system and 24 V system or 36 V system). Furthermore, when information on an internal combustion engine (e.g., an air-fuel ratio or an EGR (Exhaust Gas Recirculation) amount) is inputted to the gate control circuit 19, it is made possible to make the limit value correspond to the operation condition of the internal combustion engine.

Embodiment 2

Figure 4:
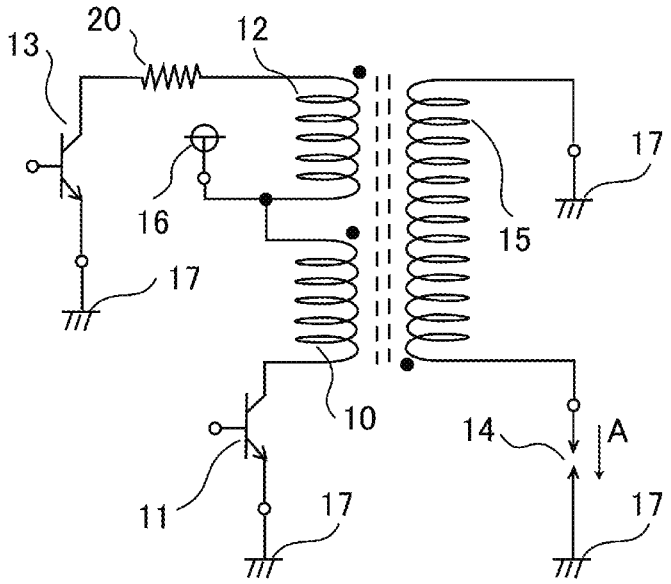
FIG. 4 is a circuit diagram representing an ignition apparatus according to Embodiment 2.

FIG. 4 is a circuit diagram representing an ignition apparatus according to Embodiment 2. Because the basic circuit configuration, the operational principle, and the operation waveforms are the same as those in Embodiment 1, duplicate descriptions therefor will be omitted. As represented in FIG. 4, in the ignition apparatus according to Embodiment 2, a current limiting resistor 20 for limiting the sub-primary current is connected between the sub-primary coil 12 and the sub-IC 13. In Embodiment 2, the current detection resistor 18 and the gate control circuit 19 in Embodiment 1 are not provided. The other configurations are the same as those in Embodiment 1.

The ignition apparatus according to Embodiment 2 is configured in such a manner as described above; hereinafter, the present Embodiment will be explained with specific values shown. In Embodiment 2, designing is implemented in such a way that the voltage drop caused by the resistance of the secondary coil 15 becomes substantially 0.5 kV when the energization of the sub-IC 13 is started; with regard to the ignition plug 14 to be connected, it is assumed that the ignition plug 14 is a resistor-incorporated plug, that the voltage across the gap is 1 kV, and that the voltage drop caused by the incorporated resistor is substantially 0.5 kV. Therefore, the induction voltage across the secondary coil 15 becomes 2 kV, which is the addition of the foregoing voltage drop of 1 kV and the voltage across the ignition plug of 1 kV. Because the turn ratio between the sub-primary coil 12 and the secondary coil 15 is set to 200, the induction voltage caused across the sub-primary coil 12 becomes substantially 10 V. The voltage between the collector and the emitter of the sub-IC 13 is set in such a way as to be substantially 2 V; the resistance of the sub-primary coil 12 is set to substantially 0.2 S.

As is the case with Embodiment 1, in the case where the current limiting resistor 20 is not provided, the sub-primary current becomes substantially 10 A and the assist current becomes substantially 50 mA; however, because in the present Embodiment, the current limiting resistor 20 is inserted into the path where the sub-primary current flows and the resistor value thereof is set to 0.3 S, the current that flows in the sub-primary coil 12 decreases and becomes substantially 4 A. As a result, the secondary superimposition current becomes 20 mA.

Because the insertion of the current limiting resistor 20 causes the assist current decrease, it is required to make the value of the after-superimposition current remain the same, for example, by increasing the secondary current generated through the main primary coil 10, which is the origin of the superimposition.

In contrast to the foregoing case, when for example, the ignition plug 14 to be utilized is replaced by a resistance-less ignition plug (the incorporated resistor is 0 kΩ), no voltage drop is caused by the incorporated resistor; therefore, the induction voltage generated across the secondary coil 15 decreases and hence the induction voltage generated across the main primary coil 10 or the sub-primary coil 12 also decreases. As a result, the voltage to be applied to the sub-primary coil 12 increases and hence the sub-primary current increases.

In the case where when the current limiting resistor 20 is not provided, the incorporated resistor of the ignition plug 14 becomes zero, the current that flows in the sub-primary coil 12 increases up to substantially 16 A (increasing by 6 A) and hence the assist current becomes substantially 80 mA; thus, in comparison with the case where the ignition plug 14 has a resistance, the secondary current and the superimposition current totally increase by 30 mA. In contrast, in the case of the present Embodiment where the current limiting resistor 20 is inserted, when the incorporated resistor of the ignition plug 14 becomes zero, the sub-primary current increases up to substantially 7 A (increasing by 3 A) and hence the assist current becomes substantially 40 mA. Accordingly, in comparison with the case where the ignition plug 14 has a resistance, the secondary current and the superimposition current totally increase by 15 mA.

As described above, the insertion of the current limiting resistor 20 into the path of the sub-primary current makes it possible to suppress the increasing amount of the sub-primary current, and hence it is made possible to reduce the respective increasing amounts of the superimposition current and the secondary current. Moreover, the current limiting resistor 20 makes it possible to suppress the sub-primary current without increasing the voltage across the sub-primary coil 12 and the voltage between the collector and the emitter of the sub-IC 13; thus, because heat generation in the sub-primary coil 12 and the sub-IC 13 can also be suppressed, for example, an IC having a small heat capacity can be utilized as the sub-IC.

In Embodiment 2, in order to compensate the decrease in the superimposition current, caused by insertion of the current limiting resistor 20, the secondary current generated through the main primary coil 10 is increased; however, it may be also allowed that for example, the resistance value of the secondary coil 15 is decreased or the turn ratio is increased so that the superimposition current the same as that at a time when the current limiting resistor 20 is not inserted can be secured.

Moreover, the current limiting resistor 20 is inserted between the sub-primary coil 12 and the sub-IC 13; however, no problem is posed even when the current limiting resistor 20 is inserted in the path into which only the sub-primary current flows, for example, at the place between the sub-IC 13 and the GND 17. Furthermore, the current limiting resistor 20 may be a variable resistor; for example, in this situation, the control may be performed in such a way that in an assumed normal state, the current limiting resistor 20 is set to 0 S and the resistance thereof is increased when the voltage across the gap of the ignition plug 14 changes (decreases). As is the case with Embodiment 1, in the normal state where the voltage of the power source 16 or the voltage to be applied to the ignition plug 14 does not change, the current that flows in the sub-primary coil 12 is set to be unlimited, so that the sub-primary current is not limited; thus, the output performance in the normal state is not limited.

Although the present application is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations to one or more of the embodiments.

It is therefore understood that numerous modifications which have not been exemplified can be devised without departing from the scope of the present application. For example, at least one of the constituent components may be modified, added, or eliminated. At least one of the constituent components mentioned in at least one of the preferred embodiments may be selected and combined with the constituent components mentioned in another preferred embodiment.

What is claimed is:

1. An ignition apparatus comprising:

a main primary coil that generates positive-direction energization magnetic flux when energized by a power source and generates opposite-direction de-energization magnetic flux when de-energized;

a main switching device that is connected with the main primary coil and performs switching between energization and de-energization of the main primary coil;

a sub-primary coil that generates magnetic flux having a direction the same as that of the de-energization magnetic flux when energized by the power source;

a sub-switching device that is connected with the sub-primary coil and performs switching between energization and de-energization of the sub-primary coil; and a secondary coil whose one terminal is connected with an ignition plug and that is magnetically coupled with the main primary coil and the sub-primary coil so as to generate discharge energy, wherein a voltage generated in the secondary coil at a timing when the main switching device is de-energized generates a secondary current; then, the sub-switching device is energized and hence the sub-primary coil is energized so that a superimposition current is generated in the secondary coil and a current flowing in the sub-primary coil is limited, wherein a first terminal of the sub-primary coil is connected to the power source and a second terminal of the sub-primary coil is connected to the sub-switching device, and wherein a gate voltage of the sub-switching device is controlled based on detection of the current flowing in the sub-primary coil.

2. The ignition apparatus according to claim 1, wherein the current flowing in the sub-primary coil is limited by increasing a voltage between a collector and an emitter of the sub-switching device.

3. The ignition apparatus according to claim 2, wherein the voltage between the collector and the emitter of the sub-switching device is variable.

4. The ignition apparatus according to claim 3, wherein in a normal state where the voltage of the power source or a voltage to be applied to the ignition plug does not change, the current that flows in the sub-primary coil is set to be unlimited.

5. The ignition apparatus according to claim 2, wherein the limit value of the current that flows in the sub-primary coil is set to 10 A through 20 A.

6. The ignition apparatus according to claim 1, wherein a current limiting resistor is inserted into a path in which only the current flowing in the sub-primary coil flows.

7. The ignition apparatus according to claim 6, wherein the current limiting resistor is formed of a variable resistor.

8. The ignition apparatus according to claim 7, wherein in a normal state where the voltage of the power source or a voltage to be applied to the ignition plug does not change, the current that flows in the sub-primary coil is set to be unlimited.

9. The ignition apparatus according to claim 1, wherein a limit value of the current that flows in the sub-primary coil is set to 10 A through 20 A.

10. An ignition apparatus comprising:

a main primary coil that generates positive-direction energization magnetic flux when energized by a power source and generates opposite-direction de-energization magnetic flux when de-energized;

a main switching device that is connected with the main primary coil and performs switching between energization and de-energization of the main primary coil;

a sub-primary coil that generates magnetic flux having a direction the same as that of the de-energization magnetic flux when energized by the power source;

a sub-switching device that is connected with the sub-primary coil and performs switching between energization and de-energization of the sub-primary coil;

a current limiting resistor having a first terminal connected to a first terminal of the sub-primary coil; and a secondary coil whose one terminal is connected with an ignition plug and that is magnetically coupled with the main primary coil and the sub-primary coil so as to generate discharge energy, wherein a voltage generated in the secondary coil at a timing when the main switching device is de-energized generates a secondary current; then, the sub-switching device is energized and hence the sub-primary coil is energized so that a superimposition current is generated in the secondary coil and a current flowing in the sub-primary coil is limited by the current limiting resistor, wherein a second terminal of the sub-primary coil is connected to the power source and a second terminal of the current limiting resistor is connected to the sub-switching device.

11. An ignition apparatus comprising:

a main primary coil that generates positive-direction energization magnetic flux when energized by a power source and generates opposite-direction de-energization magnetic flux when de-energized;

a main switching device that is connected with the main primary coil and performs switching between energization and de-energization of the main primary coil;

a sub-primary coil that generates magnetic flux having a direction the same as that of the de-energization magnetic flux when energized by the power source;

a sub-switching device that is connected with the sub-primary coil and performs switching between energization and de-energization of the sub-primary coil; and a secondary coil whose one terminal is connected with an ignition plug and that is magnetically coupled with the main primary coil and the sub-primary coil so as to generate discharge energy, wherein a voltage generated in the secondary coil at a timing when the main switching device is de-energized generates a secondary current; then, the sub-switching device is energized and hence the sub-primary coil is energized so that a superimposition current is generated in the secondary coil, and wherein a current flowing in the sub-primary coil is limited by increasing a voltage between a collector and an emitter of the sub-switching device.

12. The ignition apparatus according to claim 11, wherein the voltage between the collector and the emitter of the sub-switching device is variable.

13. The ignition apparatus according to claim 12, wherein in a normal state where the voltage of the power source or a voltage to be applied to the ignition plug does not change, the current that flows in the sub-primary coil is set to be unlimited.

14. The ignition apparatus according to claim 11, wherein a limit value of the current that flows in the sub-primary coil is set to 10 A through 20 A.

* * * * *